US007140955B2

(12) United States Patent
Nabeya

(10) Patent No.: US 7,140,955 B2
(45) Date of Patent: Nov. 28, 2006

(54) POLISHING APPARATUS

(75) Inventor: Osamu Nabeya, Kanagawa (JP)

(73) Assignee: Ebara Corporation, Tokyo (JP)

( * ) Notice: Subject to any disclaimer, the term of this patent is extended or adjusted under 35 U.S.C. 154(b) by 542 days.

(21) Appl. No.: 10/160,017

(22) Filed: Jun. 4, 2002

(65) Prior Publication Data

US 2002/0187735 A1 Dec. 12, 2002

(30) Foreign Application Priority Data

Jun. 6, 2001 (JP) ..... 2001/170877

(51) Int. Cl.
*B24B 5/00* (2006.01)
*B24D 15/00* (2006.01)

(52) U.S. Cl. ..... 451/287; 451/526; 451/528; 451/529

(58) Field of Classification Search ..... 451/285–289, 451/526, 527, 528, 529
See application file for complete search history.

(56) References Cited

U.S. PATENT DOCUMENTS 5,076,024 A * 12/1991 Akagawa et al. ..... 451/550
5,725,420 A * 3/1998 Torii ..... 451/285
5,876,271 A * 3/1999 Oliver ..... 451/60
5,888,121 A * 3/1999 Kirchner et al. ..... 451/41
6,056,851 A * 5/2000 Hsieh et al. ..... 156/345.12
6,062,964 A * 5/2000 Chen et al. ..... 451/446
6,159,088 A * 12/2000 Nakajima ..... 451/527
6,196,907 B1 * 3/2001 Kahn ..... 451/446
6,241,596 B1 * 6/2001 Osterheld et al. ..... 451/527
6,273,806 B1 * 8/2001 Bennett et al. ..... 451/527
6,413,388 B1 * 7/2002 Uzoh et al. ..... 204/224 R
6,428,405 B1 * 8/2002 Tsuchiya ..... 451/526
6,572,445 B1 * 6/2003 Laursen ..... 451/10
6,641,462 B1 * 11/2003 Eaton ..... 451/41
2003/0092363 A1 * 5/2003 Laursen et al. ..... 451/41

* cited by examiner

*Primary Examiner*—M. Rachuba
(74) *Attorney, Agent, or Firm*—Wenderoth, Lind & Ponack, L.L.P.

(57) ABSTRACT

A polishing apparatus includes a plurality of polishing fluid supply openings terminating in a polishing surface of a polishing table, and a plurality of grooves which are formed in the polishing surface and arranged so as not to be in direct communication with the polishing fluid supply openings. The polishing apparatus further includes a polishing fluid supply system for supplying a polishing fluid to a surface of a substrate through the openings. The grooves may extend at right angles relative to one another so as to define a plurality of lands therebetween, and the polishing fluid supply openings are formed through the lands.

20 Claims, 8 Drawing Sheets

*Fig. 3*

| SLURRY SUPPLY RATE | POLISHING RATE AND POLISHING UNIFORMITY OBTAIND BY MEASURING SUBSTRATES AT POINTS WHICH ARE SPACED APART FROM EACH OTHER AT PREDETERMINAL INTERVALS IN A RADIAL DIRECTION | | | POLISHING RATE AND POLISHING UNIFORMITY OBTAIND BY MEASURING SUBSTRATES AT POINTS WHICH ARE SPACED APART FROM EACH OTHER AT PREDETERMINED INTERVALS IN A CIRCUMFERENTIAL DIRECTION | | | VIBRATION |
|---|---|---|---|---|---|---|---|
| | P/R(nm/min.) | Uni.(1 σ)(%) | Uni.(M−m)(%) | P/R(nm/min.) | Uni.(1 σ)(%) | Uni.(M−m)(%) | |
| 40(ml/min.) | 55.5 | 8.0 | 23.0 | 47.3 | 22.0 | 31.7 | MINUTE |
| 50(ml/min.) | 56.0 | 9.3 | 25.3 | 46.1 | 24.1 | 31.6 | NO |
| 75(ml/min.) | 55.6 | 10.3 | 26.2 | 46.4 | 23.5 | 32.5 | NO |
| 100(ml/min. | 57.4 | 8.7 | 24.9 | 47.6 | 22.9 | 31.5 | NO |

POLISHING APPARATUS

BACKGROUND OF THE INVENTION

This invention relates to a substrate polishing apparatus for polishing a surface of a substrate, including a semiconductor wafer, and operates by pressing a surface of a substrate to be polished against a polishing surface of a polishing table, and effecting a relative motion between these respective surfaces.

Conventional substrate polishing apparatuses comprise: a polishing table; a polishing pad, which functions as a polishing surface, provided on an upper surface of the polishing table; and a substrate carrier for holding a substrate to be polished. During a polishing operation, a substrate is held in place by the substrate carrier, and a surface of the substrate to be polished is pressed against the polishing surface of the polishing table, with relative motion being effected between these respective surfaces while a polishing fluid is supplied to the polishing surface.

Recent advances in semiconductor technology, including integration density, have given rise to a need for an improved substrate polishing apparatus which is able to both uniformly and efficiently polish a substrate surface.

A conventional substrate polishing apparatus suffers from a problem in that the substrate carrier for holding a substrate to be polished vibrates during a polishing operation. This vibration is caused by a frictional force generated between the substrate and polishing surfaces when polishing liquid is not supplied appropriately. This vibration affects the apparatus as a whole, and has a negative effect on production capacity. It also generates noise in a work environment.

A further problem with this prior art apparatus is that it consumes as much as 200 ml/min of slurry as polishing fluid, which makes substrate polishing operations expensive.

In view of these stated problems of the prior art apparatus, it is an object of the present invention to provide a polishing apparatus in which substrate carrier vibration does not occur, and in which an amount of polishing fluid consumed is significantly reduced.

SUMMARY OF THE INVENTION

In order to solve these problems, the present invention provides a polishing apparatus wherein a polishing table includes a plurality of polishing fluid supply openings terminating in a polishing surface of the polishing table, and a plurality of grooves formed in the polishing surface and arranged so as not to be in direct communication with the openings. The polishing apparatus comprises a polishing fluid supply system for supplying a polishing fluid, to a surface of a substrate to be polished, through the polishing fluid supply openings.

As described above, the polishing apparatus of the present invention includes polishing fluid supply openings which open into the polishing surface of the polishing table. The polishing fluid supply system supplies polishing fluid through the polishing fluid supply openings to an interface between a substrate surface to be polished and the polishing surface of the polishing table, wherein the polishing fluid forms a uniform film. Due to existence of this film, a frictional force between the substrate surface to be polished and the polishing surface is greatly reduced, and also is kept uniform between these respective surfaces. In addition, since a polishing fluid is supplied to an interface between the substrate surface and the polishing surface which are in contact with each other, excess polishing fluid is not supplied and, as a result, an amount of fluid consumed during a polishing operation is greatly reduced.

According to another aspect of this invention there is provided a polishing apparatus wherein a polishing surface of a polishing table comprises at least one recessed portion and at least one raised portion, and the at least one raised portion is formed with at least one polishing fluid supply opening formed therethrough.

Polishing fluid is supplied through polishing fluid supply openings formed at raised or convex portions on the polishing surface. Accordingly, any polishing fluid and/or waste material to be removed after a polishing operation has been completed is able to freely flow into recessed or concave portions surrounding the raised or convex portions. Consequently, it is possible to use fresh polishing fluid for each polishing operation.

According to a further aspect of this invention, the polishing apparatus may further comprise a drainage system to which the grooves are fluidly connected so that polishing fluid supplied to the surface of the substrate to be polished is drained through the grooves. By continuously discharging the polishing fluid through the grooves during a polishing operation, the problem of the conventional apparatus wherein excess polishing fluid remains between the polishing table surface and a substrate surface can be avoided; as can a problem of waste material present in polishing fluid remaining in contact with a substrate surface, thereby preventing damage being caused to the substrate surface by waste material.

According to a still further aspect of this invention, there is provided a polishing apparatus wherein a polishing table comprises a plurality of polishing fluid supply openings terminating in a polishing surface, a polishing fluid supply chamber fluidly communicated with the openings, and a polishing fluid discharge chamber positioned under and fluidly connected to the polishing fluid supply chamber. The polishing apparatus further comprises a polishing fluid supply pipe fluidly connected to the polishing fluid supply chamber, and, a polishing fluid discharge pipe fluidly connected to the polishing fluid discharge chamber.

As stated above, the polishing apparatus comprises a polishing fluid discharge chamber which is communicated with the polishing fluid supply chamber, and a polishing fluid discharge pipe which is in fluid communication with the polishing fluid discharge chamber. By this arrangement, it is possible to efficiently replace polishing fluid in the polishing fluid chamber, with either fresh polishing fluid (slurry) or pure water, as required. By discharging polishing fluid or pure water from the discharge chamber through the discharge pipe it is further possible to prevent polishing fluid and pure water from being mixed within the supply chamber.

BRIEF DESCRIPTION OF THE DRAWINGS

FIG. 1(*b*)is a partial enlarged view of the polishing pad.

FIG. 1(*c*) is a partial sectional view of the polishing pad.

FIG. 3 shows experimental data obtained when a substrate was polished by the polishing apparatus.

DETAILED DESCRIPTION OF THE PREFERRED EMBODIMENTS

Figure 1A:
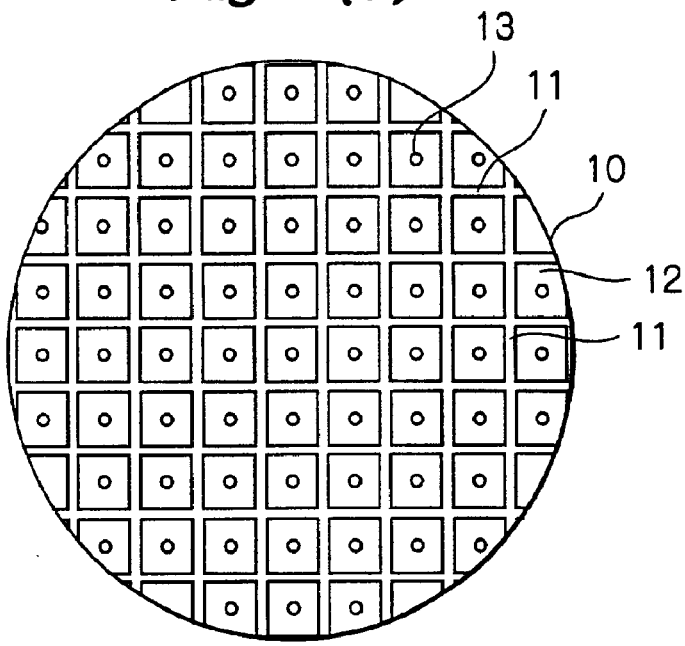
FIG. 1(*a*) is a plan view of a polishing pad used in a polishing apparatus according to the present invention.
Figure 1B:
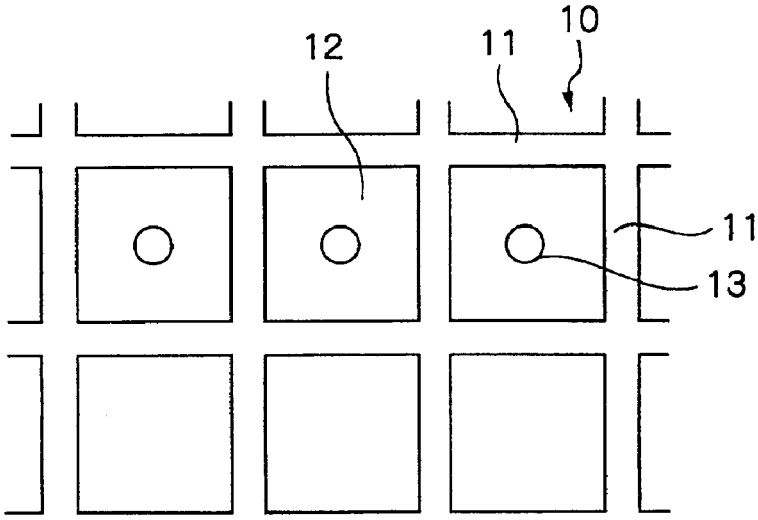
Figure 1C:
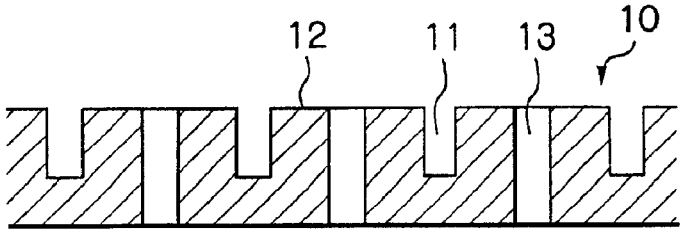

An embodiment of the present invention will now be explained with reference to the drawings. FIG. 1(*a*) is a plan view of a polishing pad to be placed on a polishing table of a polishing apparatus according to this invention. FIG. 1(*b*) is a partial enlarged view of the pad, and FIG. 1(*c*) is a partial sectional view. A polishing pad 10 is adhesively mounted on an upper surface of a polishing table and functions as a polishing surface. A plurality of grooves 11 are formed in the polishing pad 10. The grooves 11 extend at right angles relative to one another so as to form a plurality of lands 12. A plurality of openings 13 are centrally formed in respective lands 12 that open into an upper surface (polishing surface) of the polishing pad 10.

Figure 2:
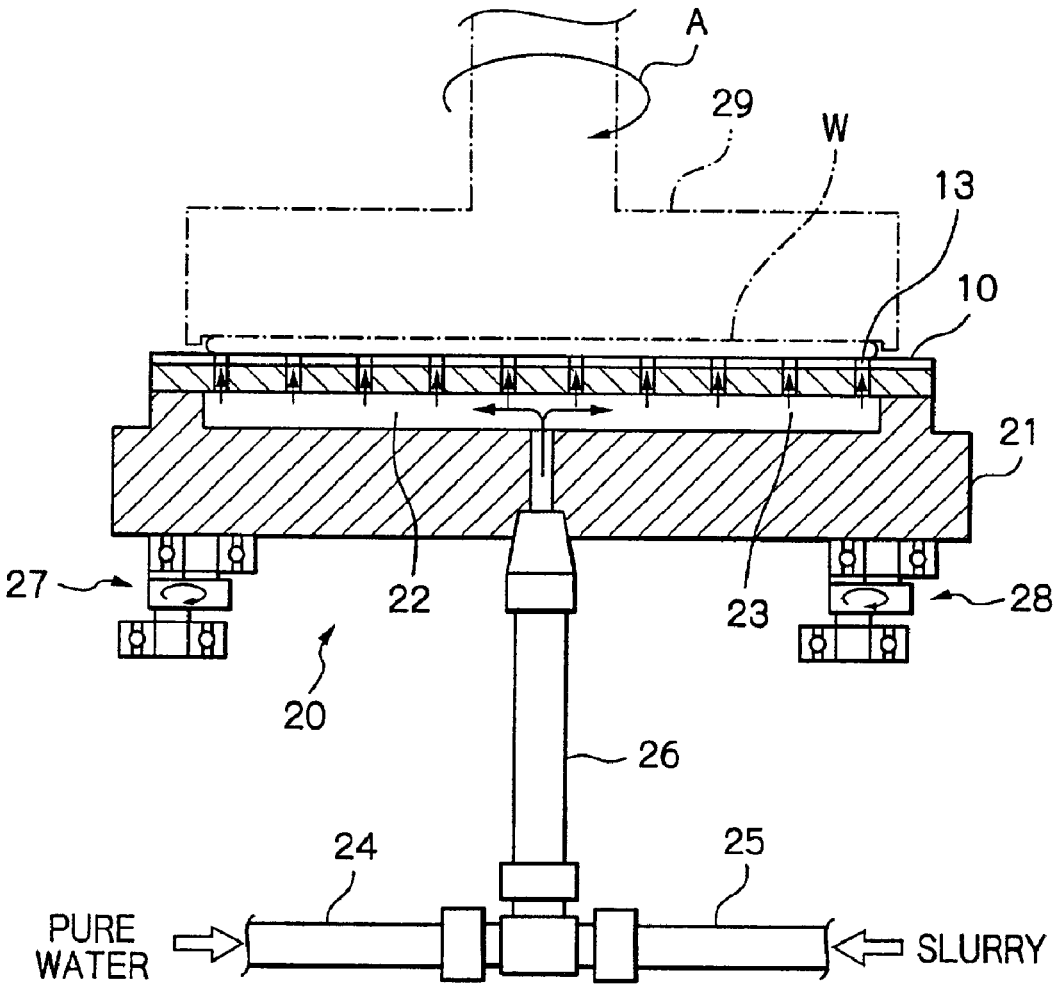
FIG. 2 is a schematic view, partly in section, of the polishing apparatus.

FIG. 2 is a schematic view, partly in section of a polishing apparatus according to one embodiment of the present invention. The polishing apparatus 20 includes a polishing table 21 on which the polishing pad 10 is adhesively mounted. A chamber 22 is formed in the polishing table 21 to receive a polishing fluid or slurry. A plurality of channels 23 are formed in an upper section of the polishing table 21 and communicated with the chamber 22. The channels 23 are also communicated with the openings 13 of the polishing pad 10.

The chamber 22 of the polishing table 21 is connected to a polishing fluid supply pipe 26. A slurry supply pipe 25 and a pure water supply pipe 24 are connected to the pipe 26. Through the pipe 25 or the pipe 24, slurry or pure water is supplied as required to fill the chamber 22. In a case of polishing a substrate, slurry is supplied as a polishing fluid; while in a case of water polishing, pure water is supplied as a polishing fluid. After polishing, the chamber 22 will be filled with pure water prior to a subsequent polishing operation.

The polishing table is supported by a plurality of rotary mechanisms 27, 28 for imparting an orbital motion to the table 21, and is caused to move in a horizontal plane by a driving mechanism such as a motor (not shown). A surface to be polished of substrate W, such as a semiconductor wafer, and which is held by a substrate carrier 29, is pressed against an upper surface of the polishing pad 10 adhesively mounted on the upper surface of the polishing table 21. The substrate carrier 29 rotates in a direction A at a fixed rate, and under a negative pressure generated between the polishing pad 10 of polishing table 21 and the substrate W held by the substrate carrier 29, polishing fluid within the chamber 22 enters an interface between the surface to be polished of the substrate W and the upper surface of the polishing pad 10, passing through channels 23 of the polishing table 21 and openings 13 of the polishing pad 10.

When the openings 13 are positioned in grooves of the polishing pad 10, and polishing fluid (slurry) was supplied at a rate of 200 ml/min, the substrate carrier 29 strongly vibrated. Increasing supply of polishing fluid restrained vibration of the substrate carrier but caused the substrate to be slightly raised in relation to the polishing pad 10, thereby decreasing a surface pressure between respective surfaces of the substrate and the polishing pad and causing a polishing rate to decrease.

However, when the openings 13 are centrally positioned in the lands 12, vibration of the substrate carrier 29 was slight, even with a polishing fluid supply rate of only 50 ml/min, while a required polishing rate was achieved. Even in a case that polishing fluid supply was increased to 100 ml/min, a polishing rate changed only slightly. From this it will be appreciated that positioning of the openings 13 is crucial in preventing vibration of the substrate carrier and conserving polishing fluid. FIG. 3 shows experimental data obtained when a substrate was polished by the polishing apparatus of the present invention.

Figure 4:
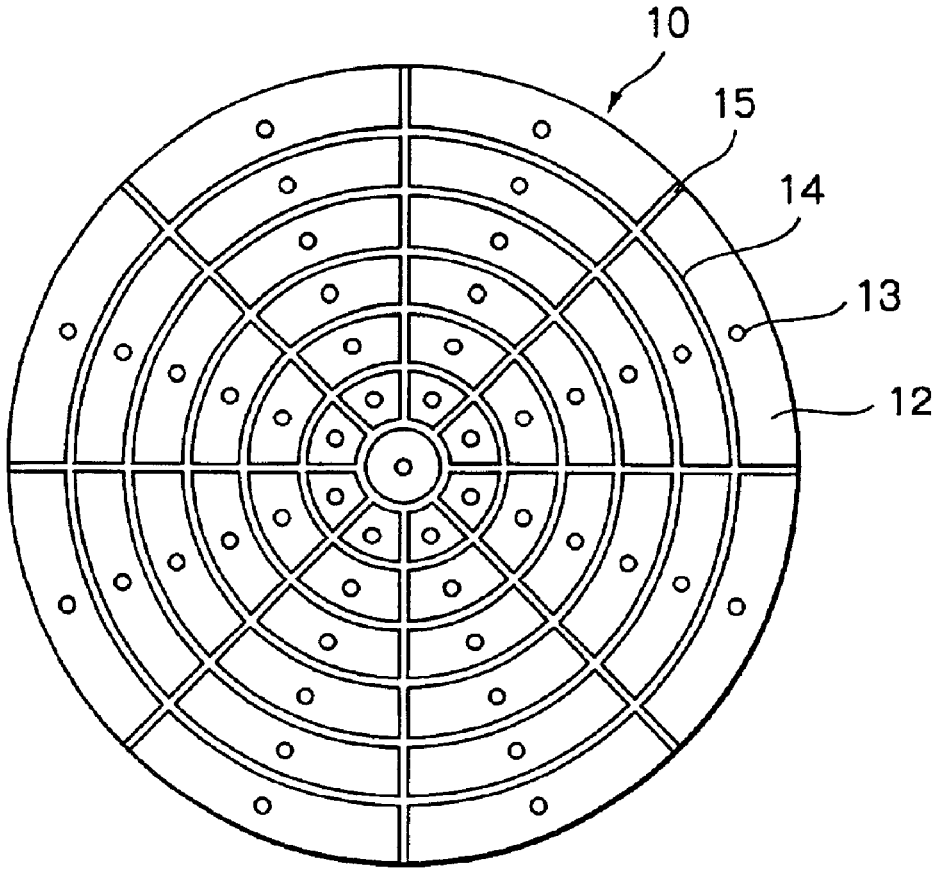
FIG. 4 is a plan view showing a polishing pad of a polishing apparatus according to the present invention.
Figure 5:
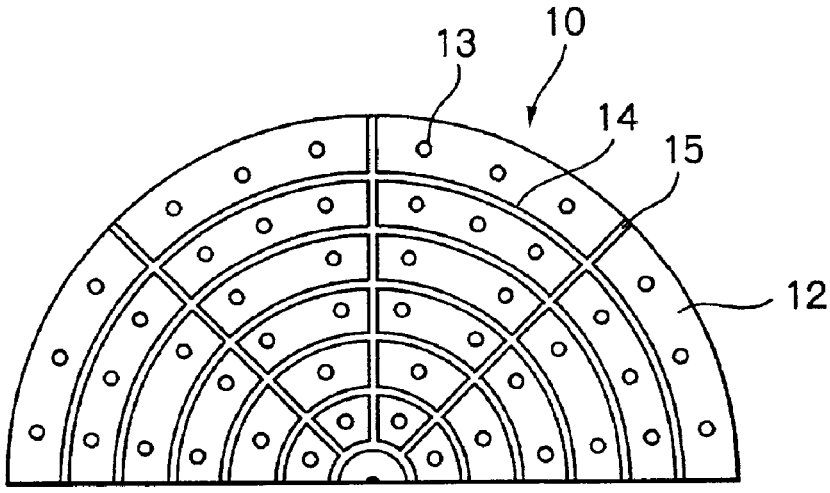
FIG. 5 is a partial plan view showing a polishing pad of a polishing apparatus according to the present invention.

With regard to slurry quantity, a polishing rate (P/R) increased by only 3% even when a supplied quantity was doubled, and thus in the polishing apparatus of the present invention a supply of polishing liquid (slurry) at a rate of 50 ml/min is sufficient. By contrast, in a polishing operation of the conventional apparatus, a polishing fluid (slurry) supply rate of 200 ml/min is required. It will be apparent, then, that the polishing apparatus according to the present invention is able to achieve a significant reduction in an amount of polishing fluid (slurry) required to be used during a polishing operation. In addition, any polishing fluid flowed into the grooves on the polishing pad after a polishing operation is immediately discharged by a draining device (not shown). As a result, polishing fluid and/or removed waste existing after a polishing operation will not adversely affect a subsequent polishing operation. In the above example, a number of grooves 11 crossing at right angles relative to one another were formed on the upper surface of the polishing pad 10, and the openings 13 were centrally formed on rectangular lands 12. However, the grooves to be formed on the upper surface of a polishing pad need not be limited to grooves crossing at right angles. As shown in FIG. 4, grooves 14 may also be formed in concentric circles on polishing pad 10, and radiating grooves 15 communicating with the grooves 14 may also be formed. Further, an opening 13 may also be formed in a land 12 defined by the concentric grooves 14 and the radiating grooves 15. As shown in FIG. 5, openings 13 formed in respective lands 12 need not be limited to one per land, and a plurality of openings may be formed in each land, depending on an area of respective lands 12.

In the foregoing example, a polishing apparatus has been explained where a polishing table 21 is subject to an orbital movement in a horizontal plane, while a substrate carrier is rotated. The polishing table may be subject to a rotational movement about its central axis in place of the orbital movement. Furthermore, the polishing table may be rotated about its central axis while being subject to an orbital movement.

Moreover, the polishing table 21 can be in the form of a belt or sheet, with the polishing apparatus being provided with a structure comprising a fluid supply device and a fluid leak prevention mechanism. Polishing pad 10 may be replaced by a rigid abrasive plate. In fact, as will be apparent to those skilled in the art, the present invention is applicable to virtually any polishing apparatus in which a surface of a substrate is polished by relative motion effected between a surface to be polished and a polishing surface of a polishing table.

In the polishing apparatus shown in FIG. 2, to enable polishing fluid to reach the upper surface (polishing surface) of the polishing pad 10 uniformly, the chamber 22 communicated with the channels 23 and the openings 13 is formed in the polishing table beneath the polishing surface of the polishing pad. The polishing fluid is supplied to the polishing surface through channels 23 and the openings 13. Since the polishing fluid must be stored in the chamber 22, when the fluid is replaced with another polishing fluid or pure water, it is necessary to expel all of the polishing fluid stored in the chamber 22 so that it flows to the upper surface or polishing surface of the polishing pad 10. However, a drawback of this operation is that it is time-consuming.

Figure 6:
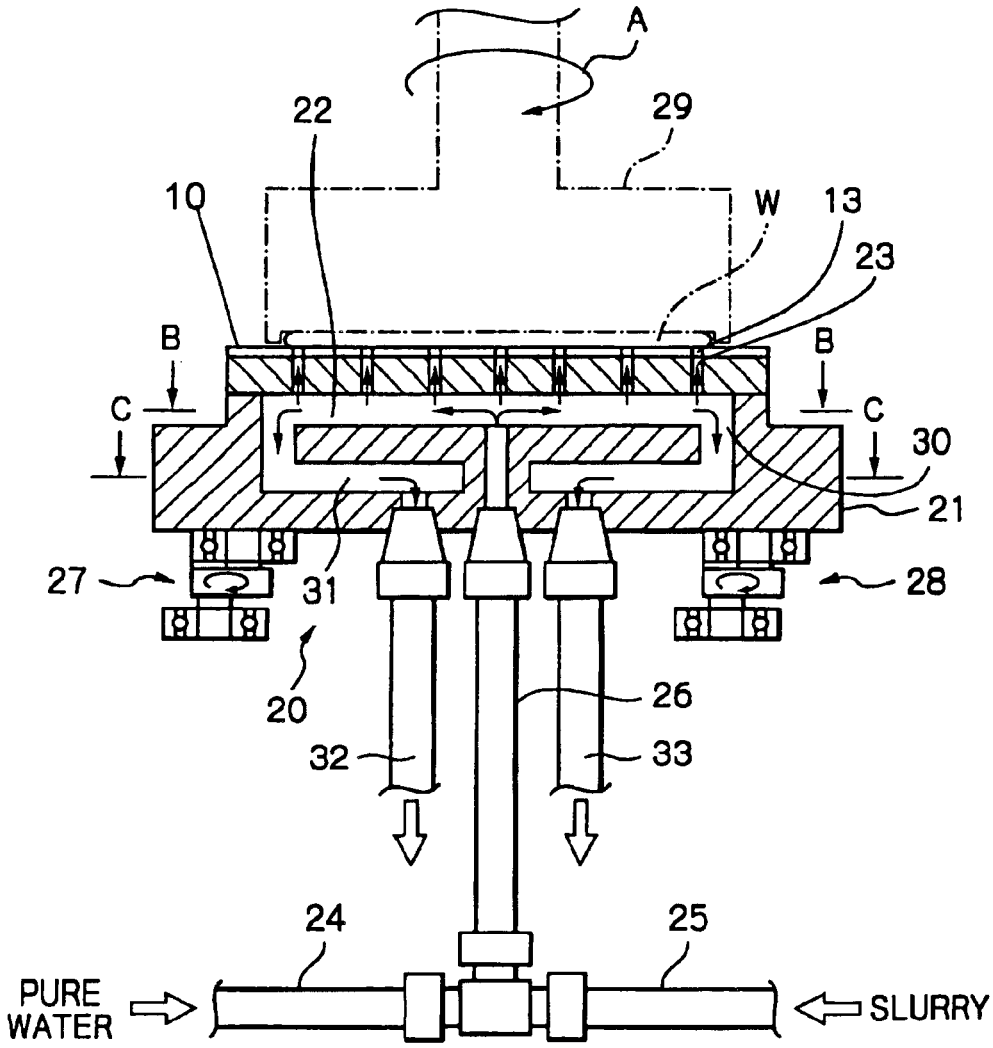
FIG. 6 is a schematic view, partly in section, of a polishing apparatus according to the present invention.
Figure 7:
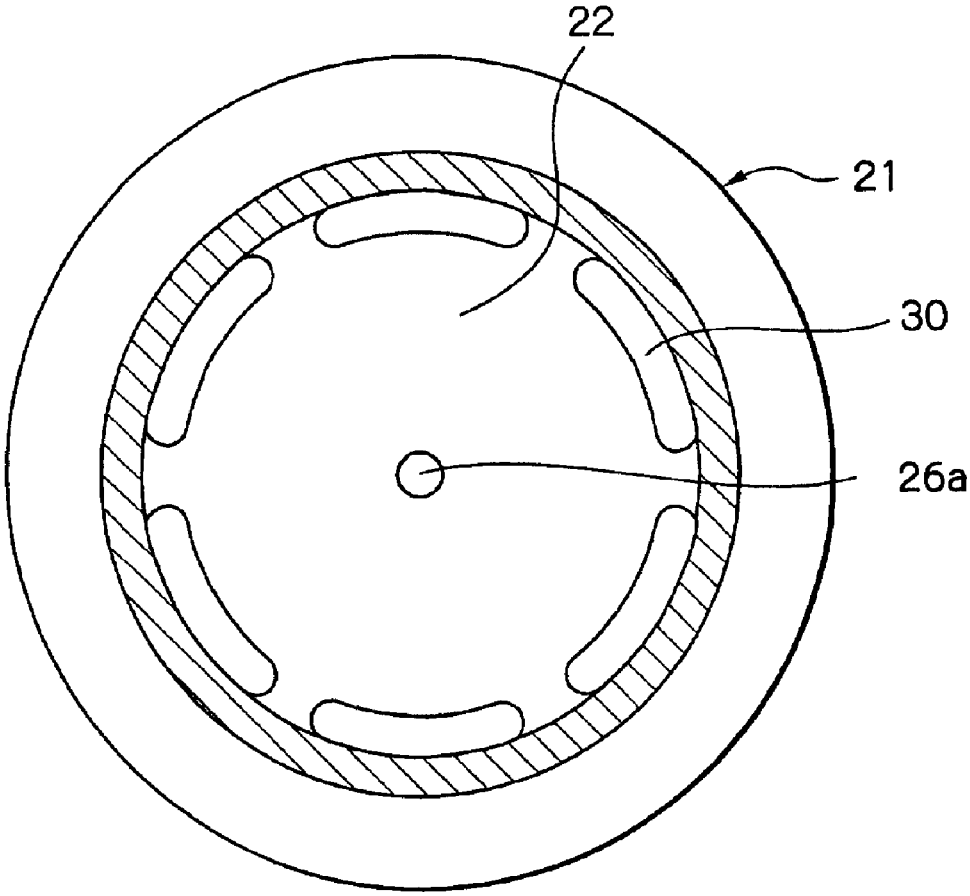
FIG. 7 is a sectional view taken along line B—B of FIG. 6.
Figure 8:
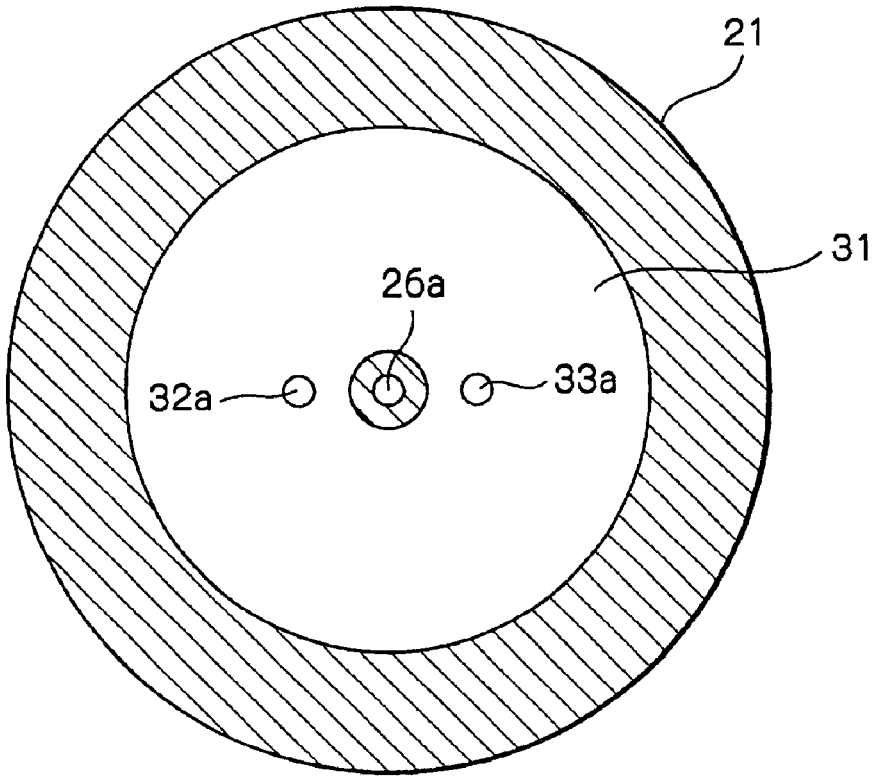
FIG. 8 is a sectional view taken along line C—C of FIG. 6.

FIGS. 6 through 8 show a polishing apparatus in accordance with another embodiment of the present invention which is provided to solve the above-mentioned drawback, i.e., excessive time consumption. FIG. 6 is a schematic view, partly in section, showing a general structure of the polishing apparatus; FIG. 7 is a sectional view of FIG. 6 taken along line B—B; and FIG. 8 is a sectional view of FIG. 6 taken along line C—C of FIG. 6.

As shown in FIGS. 6 through 8, the polishing apparatus comprises: a polishing fluid supply chamber 22 provided in a polishing table 21; a plurality of elongate holes 30 (six in FIG. 7) communicated with the supply chamber 22 at a periphery of the chamber 22; and a polishing fluid discharge chamber 31 communicated with the elongate holes 30 beneath the supply chamber 22. The polishing apparatus also comprises: an opening 26*a* communicated with a polishing fluid supply pipe 26 at a center of a lower surface of the chamber 22, and openings 32*a*, 33*a* communicated with polishing fluid discharge pipes 32, 33 respectively at a lower surface of the chamber 31. As shown in FIG. 6, openings 13 of polishing pad 10 and channels 23 are in communication with the chamber 22. The pipes 32, 33 lead to an industrial waste pipe or a polishing fluid (slurry) recycling line (not shown) through switching valves (not shown).

In the polishing apparatus of the present invention having the structure shown in FIGS. 6 through 8, pure water is filled, prior to a polishing operation, into each of the chambers 22 and 31. When it becomes necessary to replace the pure water in the chamber 22 with a polishing fluid (slurry), switching valves of the pipes 32, 33 are first opened to enable gravitational discharge of the pure water from the chamber 22, utilizing a height difference which exists between the chamber and an industrial waste pipe. The time required to complete this operation is as little as around 3 seconds.

Next, polishing fluid (slurry) is supplied to the polishing fluid supply chamber 22 through the polishing fluid supply pipe 26 at a fixed flow rate of, for example, about 500 ml/min. The polishing fluid first fills the chamber 22 and then enters the polishing fluid discharge chamber 31. Within a time of around 10 seconds, and following commencement of this polishing fluid replacement operation once the chambers are filled with polishing fluid, the switching valves are closed. In a case that polishing fluid is supplied for a further time of around, for example, 5 seconds, the openings 13 and channels 23 leading to a polishing surface of the polishing pad will be replenished with fresh polishing fluid to be made ready for a subsequent polishing operation. When polishing of a substrate W is completed and polishing fluid within the chamber 22 and the chamber 31 is replaced with pure water, the same procedures as described above will be followed, with the exception that pure water is utilized.

As stated above, the polishing apparatus comprises the polishing fluid discharge chamber 31 communicated with the chamber 22 through elongate holes 30, and the polishing fluid discharge pipes 32, 33 communicated with the chamber 31. By employing this structure having the discharge chamber 31 and polishing fluid discharge pipes 32, 33, it is possible to prevent mixing of pure water and polishing fluid (slurry) in the supply chamber 22 when a polishing fluid is replaced prior to a subsequent polishing operation.

The description of the preferred embodiments given herein is given by way of example. Changes in form and detail may be made by those skilled in the art without departing form the sprit of the present invention as defined by the following claims.

What is claimed is:

1. A polishing apparatus comprising:

a polishing table including (i) a polishing surface, (ii) polishing liquid supply openings terminating in said polishing surface, and (iii) grooves formed in said polishing surface, said grooves being arranged so as to not be in direct communication with said polishing liquid supply openings;

a substrate carrier for holding a substrate and pressing a surface of the substrate against said polishing surface while said polishing table and said substrate carrier are moved relative to each other so as to polish the surface of the substrate; and a polishing liquid supply system for supplying a polishing liquid to the surface of the substrate through said polishing liquid supply openings.

2. The polishing apparatus according to claim 1, wherein said grooves extend orthogonally relative to one another so as to define lands between said grooves, with said polishing liquid supply openings extending through said lands.

3. The polishing apparatus according to claim 2, wherein said grooves include (i) radial grooves that extend radially from a center of said polishing surface, and (ii) circular grooves intersecting said radial grooves so as to define said lands therebetween, with said circular grooves being concentric relative to the center of said polishing surface and spaced from one another.

4. The polishing apparatus according to claim 3, further comprising:

a drainage system in fluid communication with said grooves so that when polishing liquid is supplied to the surface of the substrate the polishing liquid can be drained through said grooves into said drainage system.

5. The polishing apparatus according to claim 2, further comprising:

a drainage system in fluid communication with said grooves so that when polishing liquid is supplied to the surface of the substrate the polishing liquid can be drained through said grooves into said drainage system.

6. The polishing apparatus according to claim 1, wherein said grooves include (i) radial grooves that extend radially from a center of said polishing surface, and (ii) circular grooves intersecting said radial grooves so as to define said lands therebetween, with said circular grooves being concentric relative to the center of said polishing surface and spaced from one another.

7. The polishing apparatus according to claim 1, further comprising:

a chamber in said polishing table, said chamber being in fluid communication with said polishing liquid supply openings, wherein said polishing liquid supply system includes a polishing liquid supply pipe in fluid communication with said chamber.

8. The polishing apparatus according to claim 1, further comprising:

a chamber in said polishing table, said chamber being in fluid communication with said polishing liquid supply openings, wherein said polishing liquid supply system includes (i) a polishing liquid supply pipe in fluid communication with said chamber, and (ii) a polishing liquid discharge pipe in fluid communication with said chamber.

9. The polishing apparatus according to claim 8, wherein said grooves extend orthogonally relative to one another so as to define lands between said grooves, with said polishing liquid supply openings extending through said lands.

10. The polishing apparatus according to claim 9, wherein said grooves include (i) radial grooves that extend radially from a center of said polishing surface, and (ii) circular grooves intersecting said radial grooves so as to define said lands therebetween, said circular grooves being concentric relative to the center of said polishing surface and spaced from one another.

11. The polishing apparatus according to claim 8, further comprising:

another chamber in said polishing table, said another chamber being positioned beneath and in fluid communication with said chamber, wherein said polishing liquid discharge pipe is in fluid communication with said another chamber.

12. The polishing apparatus according to claim 8, further comprising:

a drainage system in fluid communication with said grooves so that when polishing liquid is supplied to the surface of the substrate the polishing liquid can be drained through said grooves into said drainage system.

13. The polishing apparatus according to claim 1, further comprising:

a drainage system in fluid communication with said grooves so that when polishing liquid is supplied to the surface of the substrate the polishing liquid can be drained through said grooves into said drainage system.

14. The polishing apparatus according to claim 13, further comprising:

a chamber in said polishing table; and polishing liquid discharge pipe in fluid communication with said chamber.

15. The polishing apparatus according to claim 1, further comprising:

a chamber in said polishing table; and a polishing liquid discharge pipe in fluid communication with said chamber.

16. A polishing apparatus comprising:

a polishing table including (i) a polishing surface having at least one recessed portion and at least one raised portion, and (ii) at least one polishing liquid supply opening extending through said at least one raised portion;

a substrate carrier for holding a substrate and pressing a surface of the substrate against said polishing surface while said polishing table and said substrate carrier are moved relative to each other so as to polish the surface of the substrate; and a polishing liquid supply system for supplying a polishing liquid to the surface of the substrate through said at least one polishing liquid supply opening.

17. The polishing apparatus according to claim 16, further comprising:

a drainage system in fluid communication with said at least one recessed portion so that when polishing liquid is supplied to the surface of the substrate the polishing liquid can be drained through said at least one recessed portion into said drainage system.

18. The polishing apparatus according to claim 16, further comprising:

a chamber in said polishing table, said chamber being in fluid communication with said at least one polishing liquid supply opening, wherein said polishing liquid supply system includes a polishing liquid supply pipe in fluid communication with said chamber.

19. The polishing apparatus according to claim 16, further comprising:

a chamber in said polishing table, said chamber being in fluid communication with said at least one polishing liquid supply opening, wherein said polishing liquid supply system includes (i) a polishing liquid supply pipe in fluid communication with said chamber, and (ii) a polishing liquid discharge pipe in fluid communication with said chamber.

20. The polishing apparatus according to claim 19, further comprising:

another chamber in said polishing table, said another chamber being positioned beneath and in fluid communication with said chamber, wherein said polishing liquid discharge pipe is in fluid communication with said another chamber.

* * * * *